US009702516B1

(12) United States Patent
Vasquez et al.

(10) Patent No.: US 9,702,516 B1
(45) Date of Patent: Jul. 11, 2017

(54) LIGHT-EMITTING DIODE BASED RECESSED LIGHT FIXTURES

(71) Applicants: Charles Richard Vasquez, Peachtree City, GA (US); Jonathan Allin Low, Lagrange, GA (US); Jyoti Gururaj Kathawate, Smyrna, GA (US)

(72) Inventors: Charles Richard Vasquez, Peachtree City, GA (US); Jonathan Allin Low, Lagrange, GA (US); Jyoti Gururaj Kathawate, Smyrna, GA (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 15/134,258

(22) Filed: Apr. 20, 2016

(51) Int. Cl.

| | |
|---|---|
| ***F21V 7/00*** | (2006.01) |
| ***F21S 8/02*** | (2006.01) |
| ***F21V 29/76*** | (2015.01) |
| ***F21V 17/16*** | (2006.01) |
| ***F21V 13/04*** | (2006.01) |
| *F21Y 101/02* | (2006.01) |

(52) U.S. Cl.
CPC ..... *F21S 8/02* (2013.01); *F21V 13/04* (2013.01); *F21V 17/164* (2013.01); *F21V 17/166* (2013.01); *F21V 29/76* (2015.01); *F21Y 2101/02* (2013.01)

(58) Field of Classification Search
CPC ..... F21S 8/02; F21V 29/76; F21V 17/166; F21V 13/04; F21V 17/164; F21Y 2101/02
See application file for complete search history.

(56) References Cited

U.S. PATENT DOCUMENTS

| | | | |
|---|---|---|---|
| 4,055,874 | A | 11/1977 | Brown |
| 4,332,060 | A | 6/1982 | Sato |
| 4,345,308 | A | 8/1982 | Mouyard |
| 5,309,342 | A | 5/1994 | Heinen |
| 5,584,575 | A | 12/1996 | Fickel |
| 5,619,789 | A | 4/1997 | Chung |
| 5,673,997 | A | 10/1997 | Akiyama |
| 5,738,436 | A | 4/1998 | Cummings et al. |
| 5,951,151 | A | 9/1999 | Doubeck et al. |
| 6,305,829 | B1 | 10/2001 | Thomas et al. |

(Continued)

FOREIGN PATENT DOCUMENTS

KR 10-2011-008796 1/2011

OTHER PUBLICATIONS

Notice of Allowance mailed Sep. 28, 2016 for U.S. Appl. No. 15/073,395.

(Continued)

*Primary Examiner* — Tracie Y Green
(74) *Attorney, Agent, or Firm* — King & Spalding LLP

(57) ABSTRACT

A light fixture includes a light module and a trim assembly, where the trim assembly is removably coupled to the light module. The light module includes a module assembly that accommodates a light source. Further, the light module includes an additional heat sink that is optionally coupled to the module assembly. The trim assembly includes a lens, a reflector, and a trim. In particular, the reflector is coupled to the trim by inserting tabs extending downwards and substantially perpendicular from a collar of the reflector into through slots on a top collar of the trim such that the lens is securely retained and disposed in between the reflector and the trim.

20 Claims, 11 Drawing Sheets

(56) References Cited

U.S. PATENT DOCUMENTS

| | | | | |
|---|---|---|---|---|
| 6,979,107 | B1 | 12/2005 | Benensohn | |
| 7,018,070 | B2 | 3/2006 | McCoy | |
| 7,120,969 | B2 | 10/2006 | Carls | |
| 7,438,433 | B1 | 10/2008 | Steadman et al. | |
| 7,487,584 | B1 | 2/2009 | Lee | |
| 7,959,332 | B2 | 6/2011 | Tickner et al. | |
| 8,070,328 | B1 | 12/2011 | Knoble et al. | |
| 8,096,670 | B2 | 1/2012 | Trott et al. | |
| 8,215,805 | B2 | 7/2012 | Cogliano et al. | |
| 8,220,970 | B1 | 7/2012 | Khazi et al. | |
| 8,337,055 | B2 | 12/2012 | Clifton | |
| 8,348,477 | B2 | 1/2013 | Tickner et al. | |
| 8,405,947 | B1 | 3/2013 | Green et al. | |
| 8,445,144 | B2 | 5/2013 | Utsugi et al. | |
| 8,491,166 | B2 | 7/2013 | Thompson, III | |
| 8,500,305 | B2 | 8/2013 | O'Sullivan et al. | |
| 8,602,601 | B2 | 12/2013 | Khazi et al. | |
| 8,684,569 | B2 | 4/2014 | Pickard et al. | |
| 8,727,583 | B2 | 5/2014 | Russo | |
| 8,845,144 | B1 | 9/2014 | Davis et al. | |
| 9,062,866 | B1 | 6/2015 | Christ et al. | |
| 2003/0048632 | A1* | 3/2003 | Archer | E04H 4/148 362/101 |
| 2005/0265016 | A1 | 12/2005 | Rappaport | |
| 2007/0147052 | A1 | 6/2007 | Wyatt | |
| 2008/0080195 | A1 | 4/2008 | Steadman | |
| 2008/0165535 | A1* | 7/2008 | Mazzochette | F21S 8/026 362/294 |
| 2008/0285271 | A1* | 11/2008 | Roberge | F21S 8/033 362/235 |
| 2009/0086476 | A1 | 4/2009 | Tickner et al. | |
| 2009/0129086 | A1 | 5/2009 | Thompson | |
| 2010/0061108 | A1* | 3/2010 | Zhang | F21V 29/004 362/364 |
| 2010/0085759 | A1 | 4/2010 | O'Sullivan et al. | |
| 2010/0110699 | A1 | 5/2010 | Chou | |
| 2010/0226139 | A1 | 9/2010 | Lynch | |
| 2010/0246193 | A1 | 9/2010 | Clifton et al. | |
| 2011/0063849 | A1 | 3/2011 | Alexander | |
| 2011/0110095 | A1* | 5/2011 | Li | F21V 29/004 362/294 |
| 2011/0267828 | A1* | 11/2011 | Bazydola | F21S 8/02 362/373 |
| 2011/0297971 | A1 | 12/2011 | Shumizu | |
| 2012/0120645 | A1 | 5/2012 | Hawkins | |
| 2013/0010476 | A1 | 1/2013 | Pickard | |
| 2013/0294077 | A1 | 11/2013 | Gabrius | |
| 2013/0294084 | A1 | 11/2013 | Kathawate et al. | |

OTHER PUBLICATIONS

Office Action mailed Aug. 24, 2016 for U.S. Appl. No. 13/746,835 mailed Aug. 24, 2016.

* cited by examiner

LIGHT-EMITTING DIODE BASED RECESSED LIGHT FIXTURES

CROSS-REFERENCE TO RELATED APPLICATIONS

The present application is related to a patent application titled "Optical Attachment Features for an LED-based lighting system," having U.S. patent application Ser. No. 13/746,835 and filed on Jan. 22, 2013, the entire contents of which are hereby incorporated herein by reference.

TECHNICAL FIELD

The present disclosure relates generally to lighting fixtures, and in particular to light-emitting diode based recessed light fixtures.

BACKGROUND

Conventional recessed lighting fixtures include a light module and a trim that is removably attached to the light module. Typically, the light module includes a light source and optical devices (e.g., reflectors, lenses, diffusers) that are designed to control the way that light emitted by the light source is distributed from the light module. Different optical device configurations in the light module may produce different light distributions. Accordingly, a manufacturer may have to produce and maintain a stock of different light modules, each having a different configuration of the optical devices. For example, the manufacturer may have to produce at least a wide beam distribution light module, a narrow beam distribution light module, and a medium beam distribution light module to cover three different light distributions. Similarly, the manufacturer has to produce and maintain a stock of different trims because each trim is designed to pair with a specific light module based on the light distribution produced by the optical device of the light module. For example, a wide beam distribution trim pairs (attached to) with the wide beam distribution light module, a narrow beam distribution trim pairs with the narrow beam distribution light module, and/or a medium beam distribution trim pairs with the medium beam distribution light module. The multiple light modules and the corresponding multiple trims increase the number of stock keeping units (SKUs) resulting in larger manufacturing, maintenance, packaging, and shipping cost for the manufacturer. Also, more SKU's means increased product cost to the consumer because, ultimately, the higher cost of goods is reflected in a higher retail price to consumers.

Further, conventional recessed lighting fixtures may have a large profile (especially, the vertical height of the lighting fixture) that demands a large plenum space, i.e., the distance between the roof and the ceiling (e.g., drop down ceiling), for installation. The large plenum space results in increased construction costs and may limit the number of fixtures that can be installed in the space.

In light of the above shortcomings of conventional recessed lighting fixtures, there remains a need for an improved recessed lighting fixture that has a low profile for installation in a high ceiling or shallow plenum depth environment. Need also exists for an improved recessed lighting fixture that can consolidate and reduce the number of product SKUs (e.g., trim and light module units).

SUMMARY

In one aspect, the present disclosure can relate to a light fixture. The light fixture includes a light module that has a light source. Further, the light fixture includes a trim assembly that is removably coupled to the light module. The trim assembly includes a trim comprising a top collar that extends radially outward from a top edge of the trim that defines a lens receiving opening. The top collar comprises one or more through slots. Further, the trim assembly includes a reflector that has a top edge defining a first opening, a bottom edge defining a second opening that is disposed below the first opening, a body extending from the top edge of the reflector to the bottom edge of the reflector, a collar extending radially outward and substantially horizontally from the bottom edge of the reflector, and one or more tabs extending downward and substantially perpendicular to the collar of the reflector from an outer edge of the collar. Further, the trim assembly includes a lens that has a collar and a curved surface. The lens is securely retained between the reflector and the trim such that: (a) the collar of the lens is disposed between the collar of the reflector and the top collar of the trim, and (b) the curved surface of the lens is disposed below the second opening of the reflector and received through the lens receiving opening of the trim. The reflector is coupled to the trim by inserting each tab of the one or more tabs of the reflector through a respective through slot of the one or more through slots on the top collar of the trim.

In another aspect, the present disclosure can relate to a trim assembly. The trim assembly includes a trim. The trim includes a trim body that extends from the top annular edge to the bottom annular edge of the trim. The top annular edge defines a lens receiving opening and the bottom annular edge defines a light exit opening. The trim includes a top collar that extends radially outward from a top edge of the trim, wherein the top collar comprises one or more through slots. Further, the trim includes a bottom collar that extends radially outward from a bottom edge of the trim. The trim assembly further includes a reflector that has a collar that extends radially outward from a bottom edge of the reflector, and one or more tabs extending downward and substantially perpendicular to the collar of the reflector from an outer edge of the collar. Furthermore, the trim assembly includes a lens comprising a curved surface and a collar extending radially outward from a top edge of the lens. The lens is securely retained between the reflector and the trim such that: (a) the collar of the lens is disposed between the collar of the reflector and the top collar of the trim, and (b) the curved surface of the lens is disposed below the reflector and received through the lens receiving opening of the trim. Further, the reflector is coupled to the trim by inserting each tab of the one or more tabs of the reflector through a respective through slot of the one or more through slots on the top collar of the trim.

In yet another aspect, the present disclosure can relate to a light fixture. The light fixture includes a module assembly. The module assembly includes an enclosure, a wire cover member that is disposed below and coupled to the enclosure, wherein the wire cover member includes an opening, and a light source coupled to the enclosure and disposed in between the enclosure and the wire cover member such that the light source is configured to emit light through the opening of the wire cover member. Further, the light fixture includes a trim assembly that is removably coupled to the light module. The trim assembly includes a lens. Further, the trim assembly includes a trim comprising a top collar that extends radially outward from a top edge of the trim that defines a lens receiving opening. The top collar includes one or more through slots. Further, the trim assembly includes a reflector that has a collar and one or more tabs extending downwards and substantially perpendicular to the collar of the reflector from an outer edge of the collar. The reflector is coupled to the trim by inserting each tab of the one or more tabs of the reflector through a respective through slot of the one or more through slots on the top collar of the trim such that the lens is securely retained between the reflector and the trim.

These and other aspects, objects, features, and embodiments will be apparent from the following description and the appended claims.

BRIEF DESCRIPTION OF THE DRAWINGS

The foregoing and other features and aspects of the disclosure are best understood with reference to the following description of certain example embodiments, when read in conjunction with the accompanying drawings, wherein.

Figure 1:
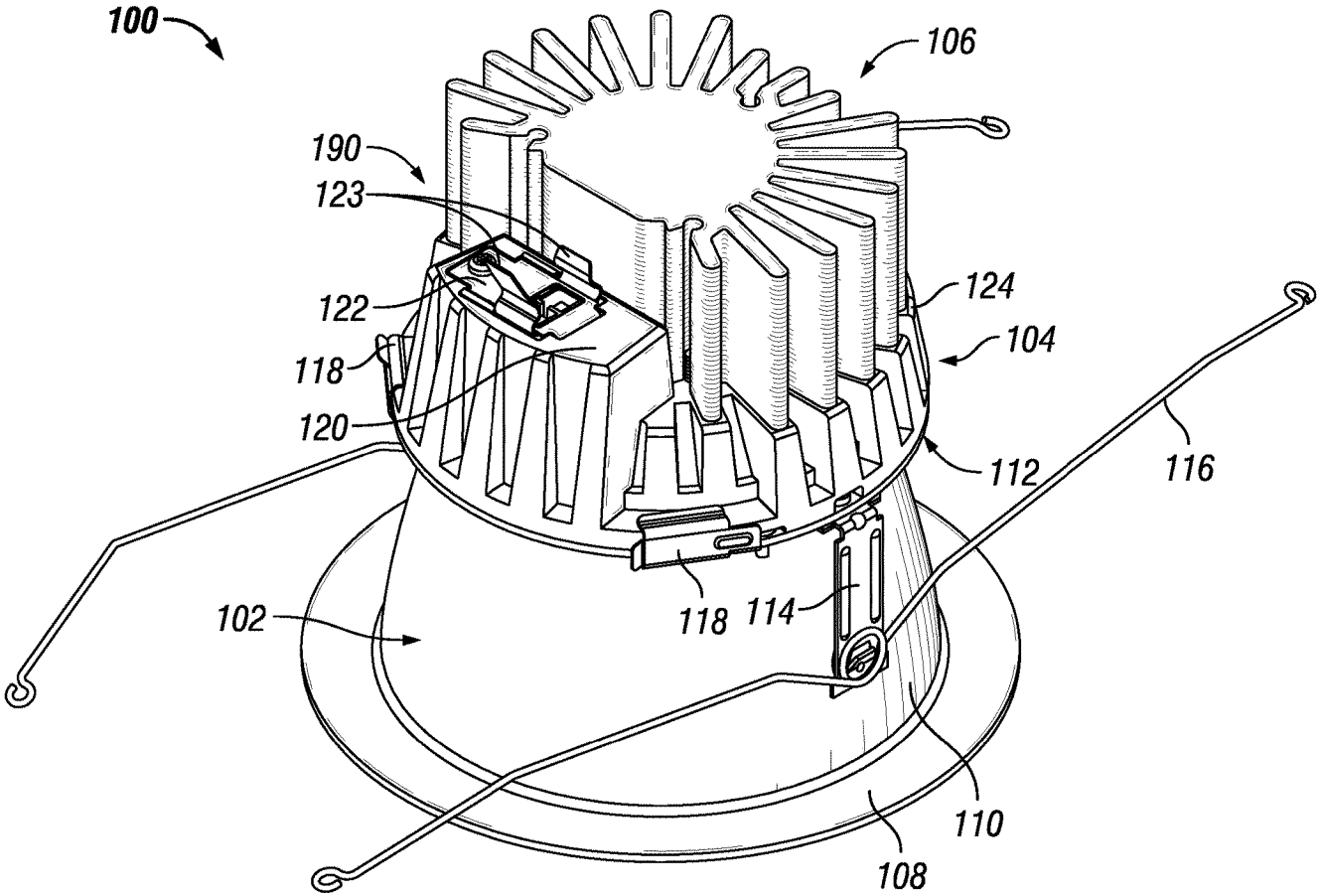
FIG. 1 illustrates a perspective view of an example light-emitting diode based recessed lighting fixture, in accordance with an example embodiment of the present disclosure.

The drawings illustrate only example embodiments of the disclosure and are therefore not to be considered limiting of its scope, as the disclosure may admit to other equally effective embodiments. The elements and features shown in the drawings are not necessarily to scale, emphasis instead being placed upon clearly illustrating the principles of the example embodiments. Additionally, certain dimensions or positionings may be exaggerated to help visually convey such principles.

DETAILED DESCRIPTION OF EXAMPLE EMBODIMENTS

In the following paragraphs, the present disclosure will be described in further detail by way of examples with reference to the attached drawings. In the description, well known components, methods, and/or processing techniques are omitted or briefly described so as not to obscure the disclosure. As used herein, the "present disclosure" refers to any one of the embodiments of the disclosure described herein and any equivalents. Furthermore, reference to various feature(s) of the "present disclosure" is not to suggest that all embodiments must include the referenced feature(s).

The present disclosure is directed to an example light-emitting diode (LED) based recessed lighting fixture (herein 'recessed lighting fixture') that includes a light module and a trim assembly that is removably coupled to the light module. The trim assembly of the present disclosure includes a trim and optical devices, i.e., an upper reflector and a lens, that are captive on the trim for shaping light from the light module into desired beam angles. In particular, the upper reflector is attached to the trim using a plurality of tabs that snap into corresponding cut outs or through slots in the trim such that the lens (specifically, a collar of the lens) is disposed in between the upper reflector and the trim. Further, the trim assembly includes optional torsion springs that can be mounted on the trim via torsion spring brackets for installing the recessed lighting fixture into a recessed housing (e.g., a can or frame).

In particular, the trim assembly having the optical devices is removably coupled to the light module using one or more coupling members, e.g., coupling clips, fasteners, etc., such that the trim assembly is field interchangeable to allow for different light beam distributions (e.g., narrow, medium, wide, square, etc.). For example, if the customer desires a narrow beam light distribution, the customer can couple a narrow beam trim assembly to a generic light module, where the reflector and lens in the narrow beam trim assembly are arranged to produce a narrow beam light output. Later, if the customer desires a wide beam distribution, the customer can replace the narrow beam trim assembly with a wide beam trim assembly by decoupling the narrow beam trim assembly from the generic light module and coupling the wide beam trim assembly to the generic light module, where the reflector and lens in the wide beam trim assembly are arranged to produce a wide beam light output. In other words, the optical control of the recessed light fixture lies in the trim assembly because the reflector and lens that allow the optical control are part of the trim assembly rather than the light module.

In the present disclosure, the light module includes a die-cast housing which includes a connector part and a heat sink part. Further, the light module includes a wire cover member that is coupled to the die-cast housing. Furthermore, the light module includes a light source that is disposed between the wire cover member and the die-cast housing. Particularly, the light source is coupled to the heat sink part of the die-cast housing such that the heat sink part dissipates heat that is generated from a light source of the recessed lighting fixture. In one example, the light source may be an LED, however, one of ordinary skill in the art can understand and appreciate that any other type of point or non-point light source may be used in the recessed lighting fixture described herein without departing from a broader scope of the present disclosure. Additionally, the light module includes one or more connector receptacles that provide a connection point for external power sources to connect to the light module and power the light source. In particular, the one or more connector receptacles are supported by the wire cover member and are disposed in the connector part of the die-cast housing.

In addition to the die-cast housing and a wire cover member, the light module may include an additional heat sink (formed by an extrusion process) that may be optionally and removably coupled to the die-cast housing using one or more fasteners to provide additional heat dissipation for higher wattage applications of the recessed lighting fixture. For example, the die-cast housing can be used as a heat sink for low lumen light modules. However, for higher lumen applications, i.e., when the power to the light source may be increased, an additional heat sink is coupled to the die-cast housing to provide an increased surface area for dissipation of the additional heat produced by the light source.

By making the optical devices captive on the trim and thereby having the optical control coming from the trim assembly rather than from the light module, the manufacturer can consolidate and reduce the number of SKUs because the manufacturer can avoid having to manufacture different light modules for different light beam distributions. Instead, the manufacturer can produce a generic light module by wattage that can be interchangeably used with different trim assemblies for different light beam distributions. For example, instead of having to manufacture and maintain three different trims and three different light modules to achieve a wide angle light beam distribution, medium angle light beam distribution, and narrow angle light beam distribution, the manufacturer can produce three different trim assemblies (e.g., for wide beam, medium beam, and narrow beam distributions) and a generic light module that can be interchangeably used with the three different trim assemblies based on the light distribution that is desired.

Additionally, the ability to couple additional heat sinks of varying lengths to the die-cast housing of the light module allows the same light module to be powered at different drive currents. Furthermore, the ability of the die-cast housing to act as a heat sink allows the recessed light fixture to operate without the additional extruded heat sinks, thereby providing the recessed light fixture a low-profile for shallow plenum installation.

The technology of the present disclosure can be embodied in many different forms and should not be construed as limited to the embodiments set forth herein; rather, these embodiments are provided so that this disclosure will be thorough and complete, and will fully convey the scope of the technology to those having ordinary skill in the art. Furthermore, all "examples" or "example embodiments" given herein are intended to be non-limiting and among others supported by representations of the present technology.

Figure 2:
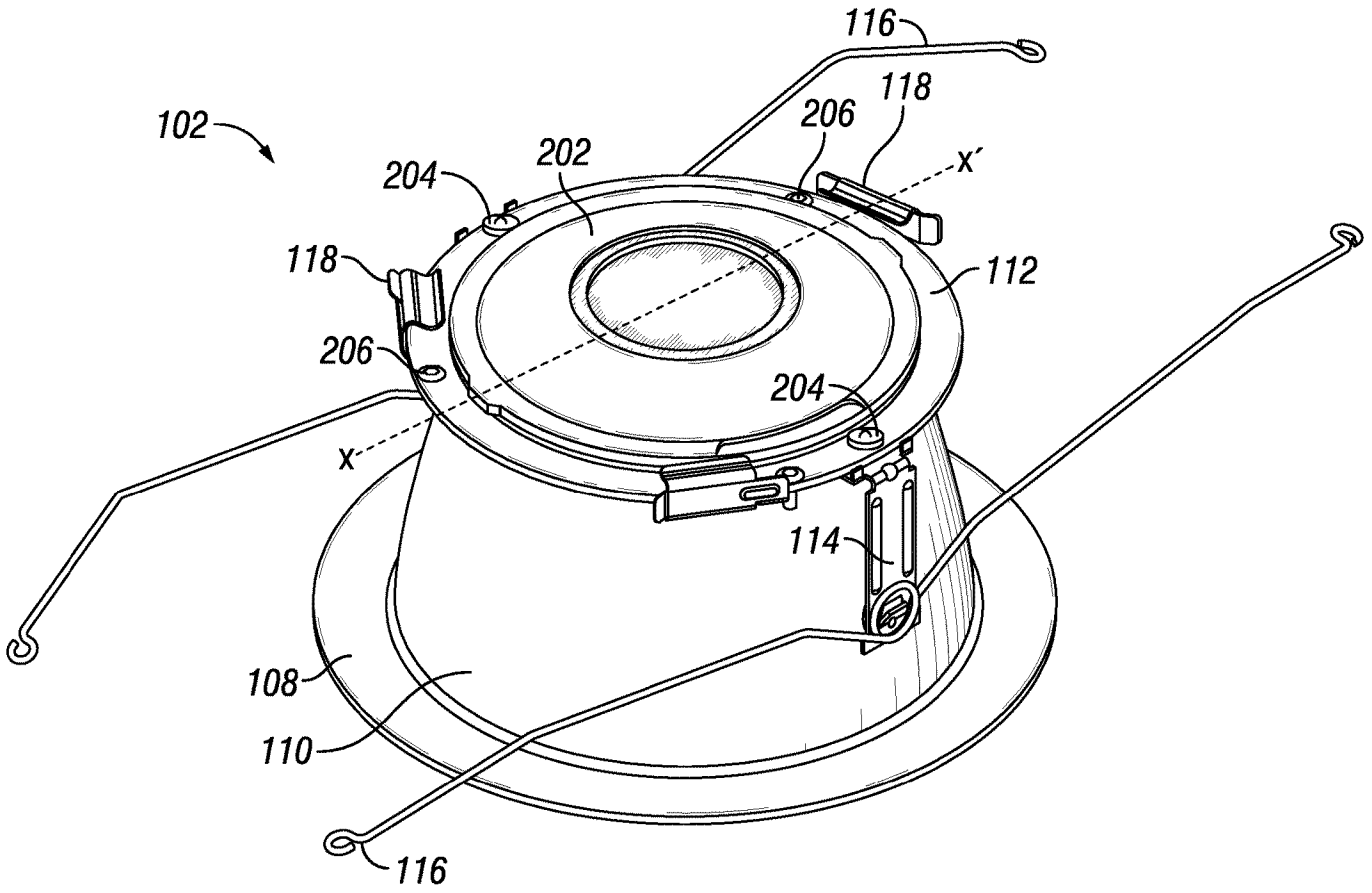
FIG. 2 illustrates a perspective view of a trim assembly of the example light-emitting diode based recessed lighting fixture of FIG. 1, in accordance with an example embodiment of the present disclosure.
Figure 3:
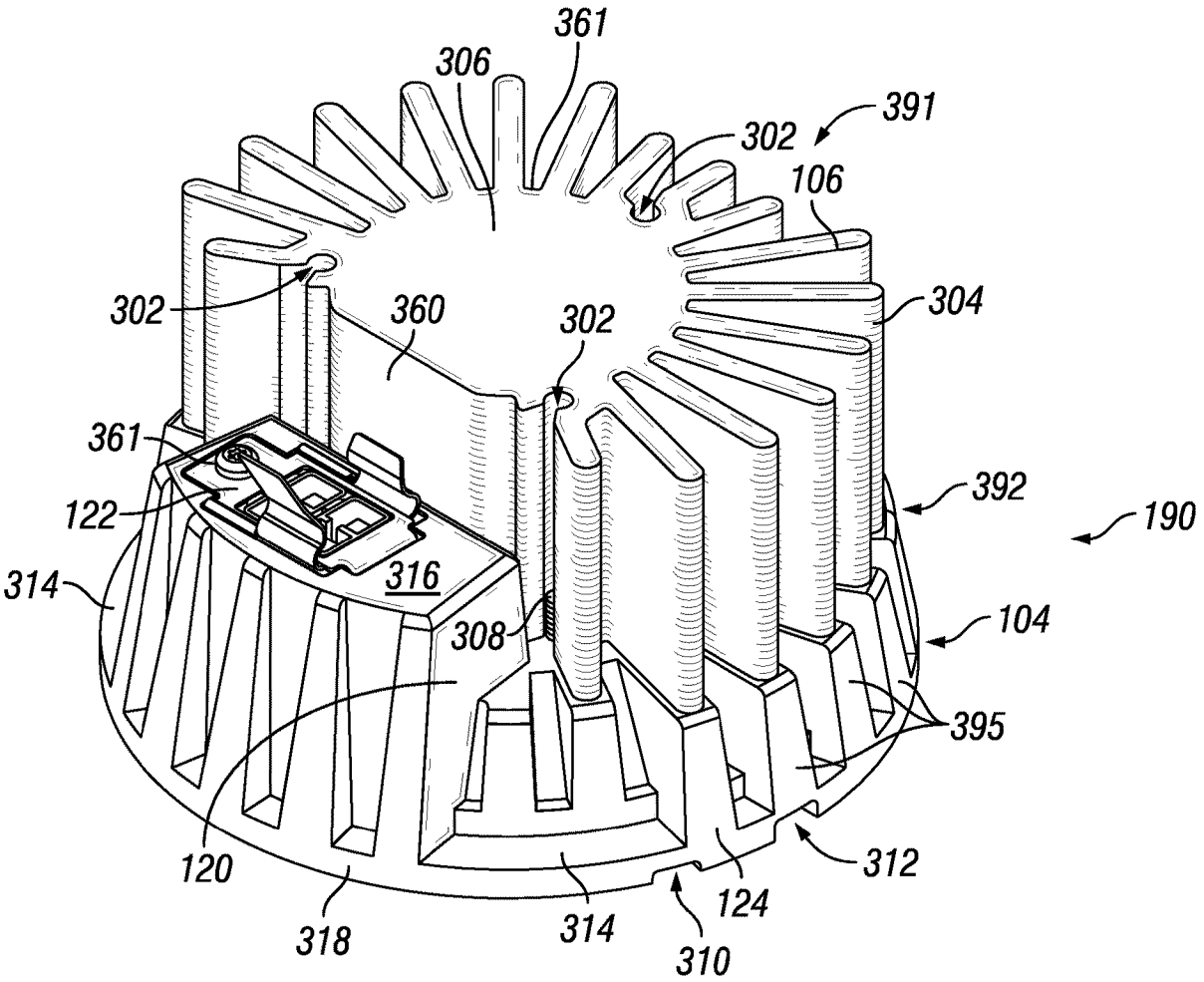
FIG. 3 illustrates a perspective view of an example light module and heat sink assembly of the light-emitting diode based recessed lighting fixture shown in FIG. 1, in accordance with an example embodiment of the present disclosure.
Figure 4:
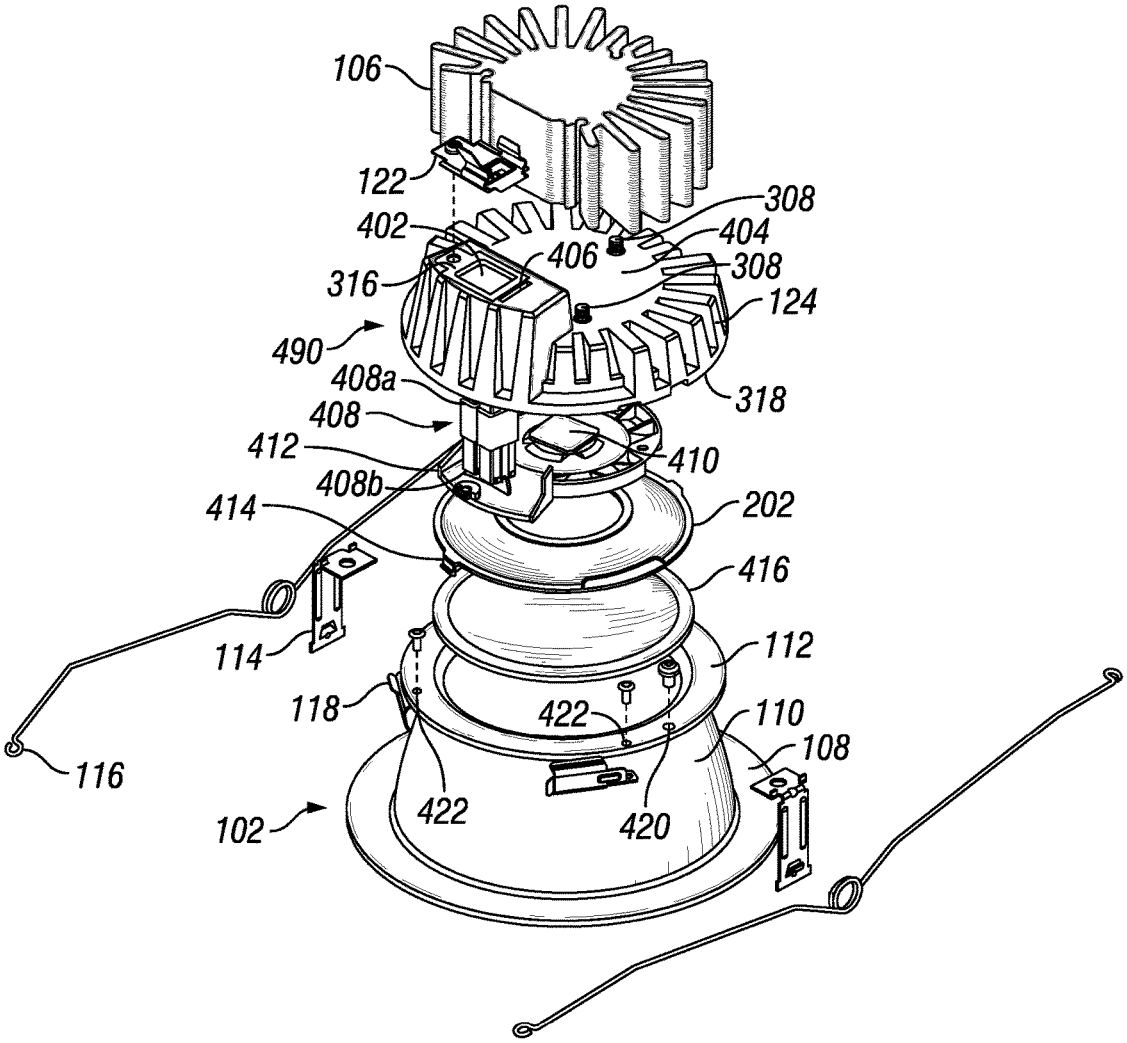
FIG. 4 illustrates an exploded view of the example light-emitting diode based recessed lighting fixture of FIG. 1, in accordance with an example embodiment of the present disclosure.

FIG. 1 illustrates a perspective view of an example light-emitting diode based recessed lighting fixture, in accordance with an example embodiment of the present disclosure; FIG. 2 illustrates a perspective view of a trim assembly of the example light-emitting diode based recessed lighting fixture of FIG. 1, in accordance with an example embodiment of the present disclosure; FIG. 3 illustrates a perspective view of an example light module and heat sink assembly of the light-emitting diode based recessed lighting fixture shown in FIG. 1, in accordance with an example embodiment of the present disclosure; and FIG. 4 illustrates an exploded view of the example light-emitting diode based recessed lighting fixture of FIG. 1, in accordance with an example embodiment of the present disclosure.

Figure 5B:
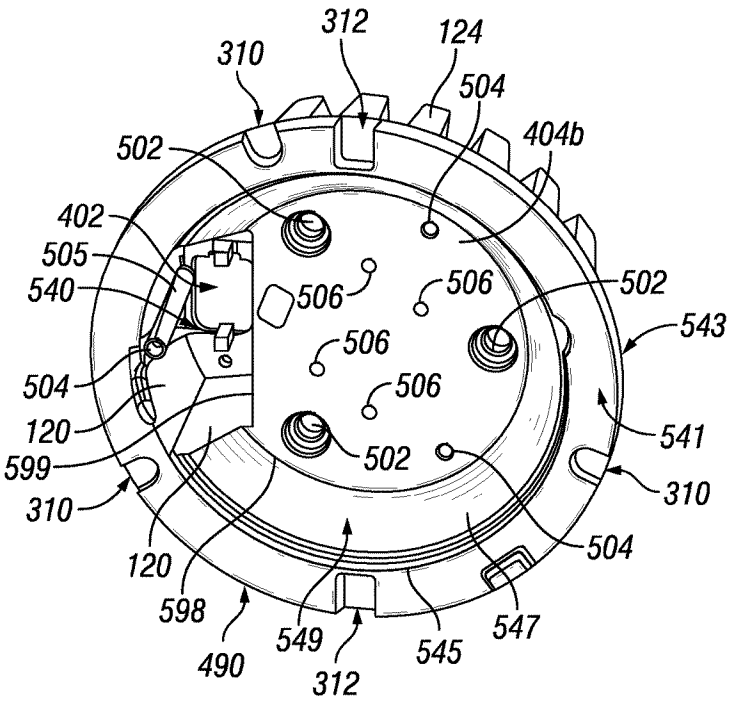
FIGS. 5A and 5B (collectively 'FIG. 5') illustrate a top perspective view and a bottom perspective view of an enclosure of the light module shown in FIG. 3, in accordance with an example embodiment of the present disclosure.
Figure 5A:
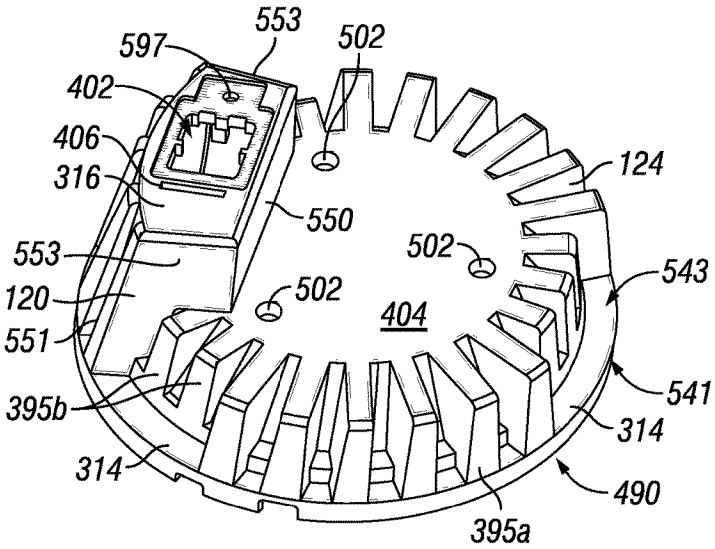
Figure 7:
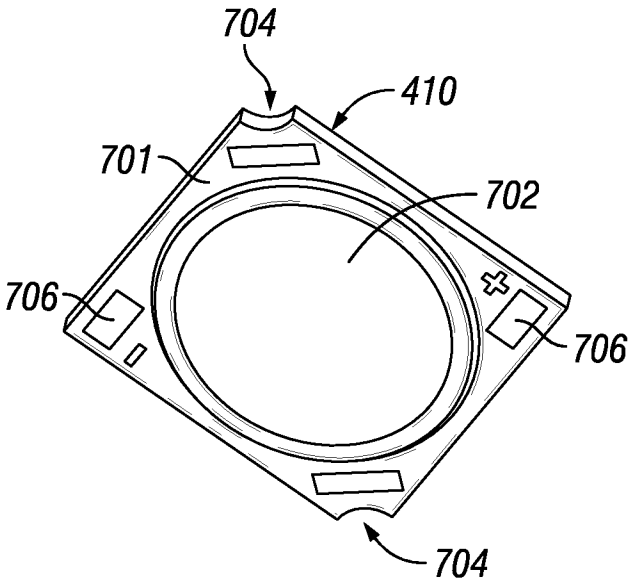
FIG. 7 illustrates a perspective view of a light source of the example light-emitting diode based recessed lighting fixture shown in FIG. 1, in accordance with an example embodiment of the present disclosure.
Figure 6:
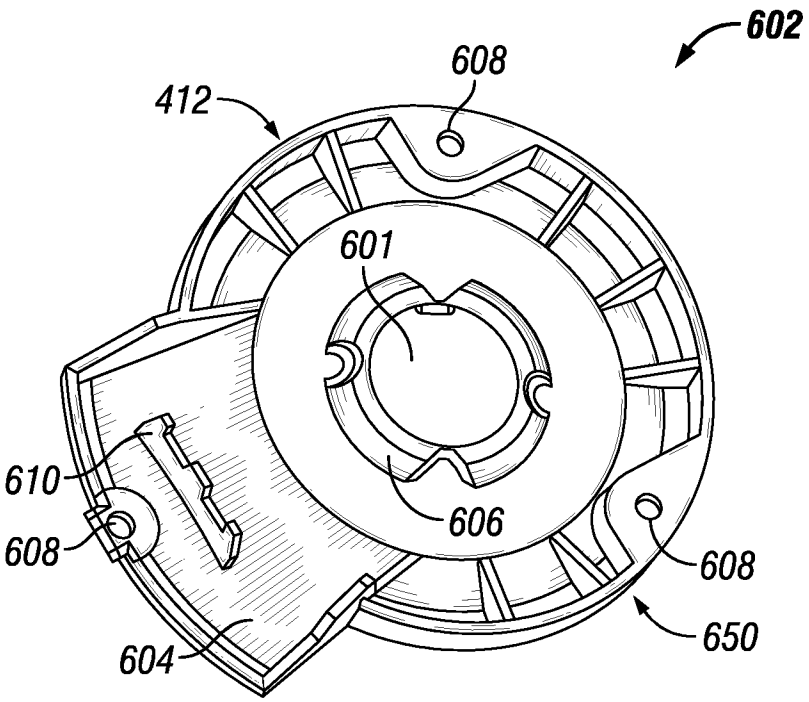
FIG. 6 illustrates a perspective view of a wire cover member of the light module shown in FIG. 3, in accordance with an example embodiment of the present disclosure.
Figure 8C:
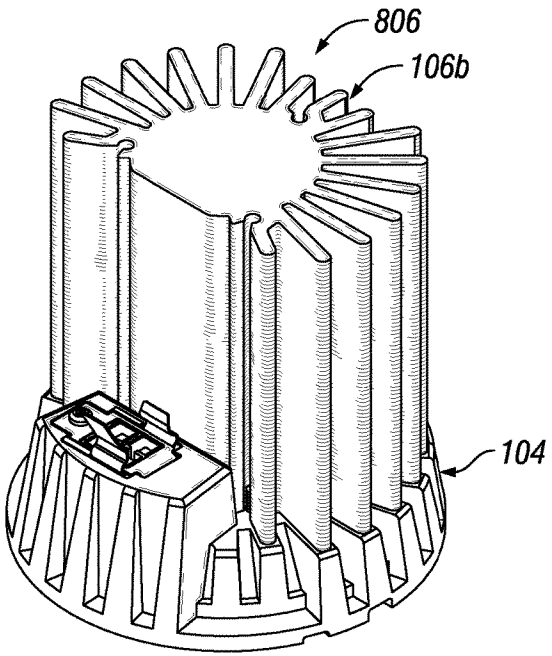
FIGS. 8A-8C (collectively 'FIG. 8') illustrate various example light module and heat sink assemblies, in accordance with an example embodiment of the present disclosure.
Figure 8A:
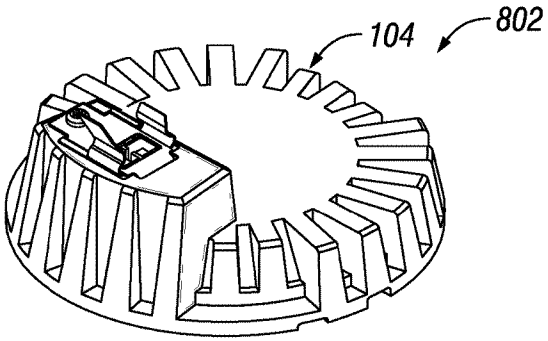
Figure 8B:
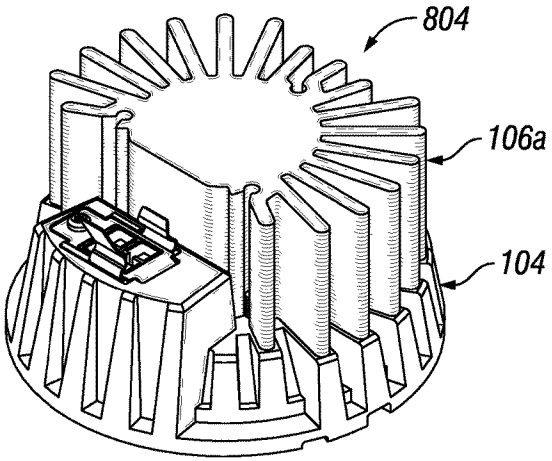
Figure 9:
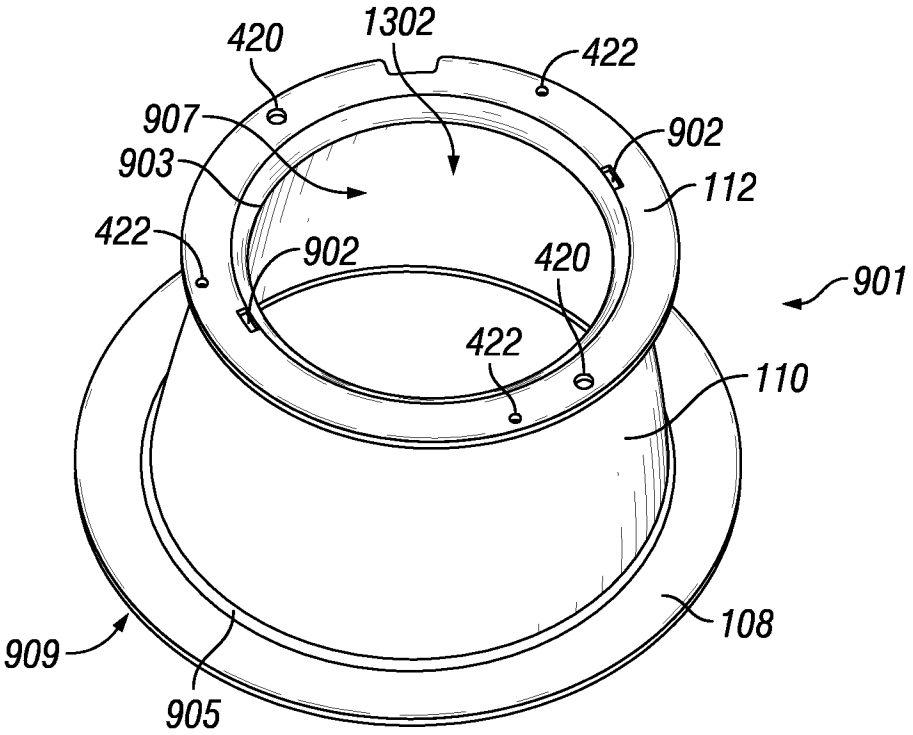
FIG. 9 illustrates a perspective view of a trim of the trim assembly shown in FIG. 2, in accordance with an example embodiment of the present disclosure.
Figure 11:
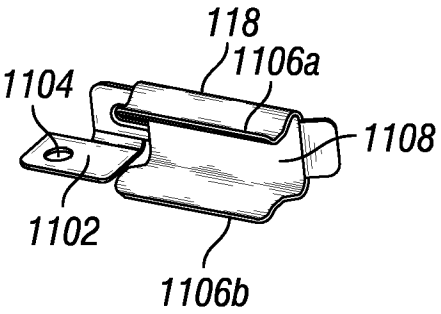
FIG. 11 illustrates a coupling clip that engages and locks the light module and/or heat sink assembly to the trim assembly, in accordance with an example embodiment of the present disclosure.
Figure 10:
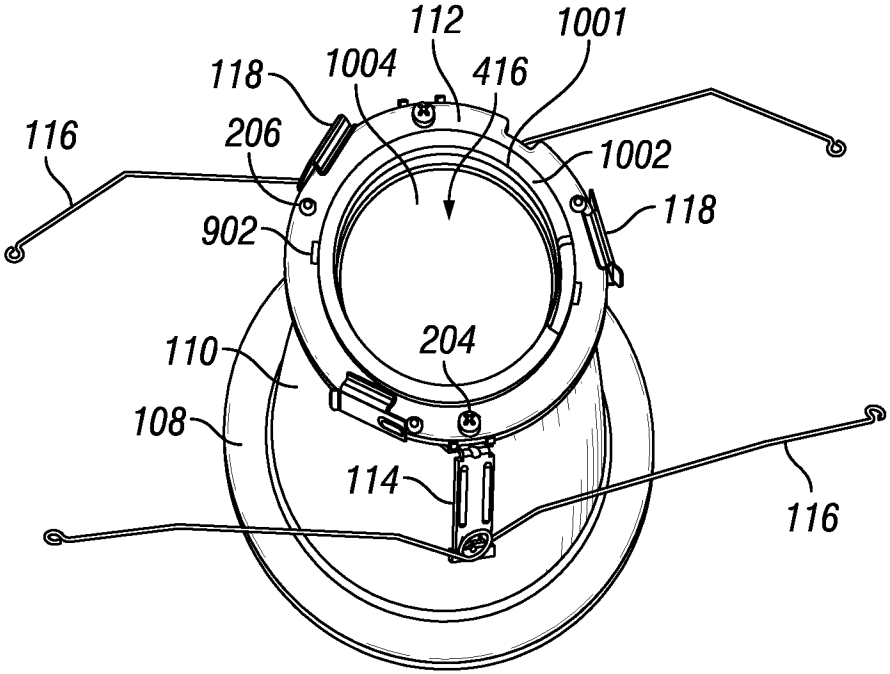
FIG. 10 illustrates a perspective view of the trim assembly of FIG. 2 with the upper reflector removed, in accordance with an example embodiment of the present disclosure.
Figure 12A:
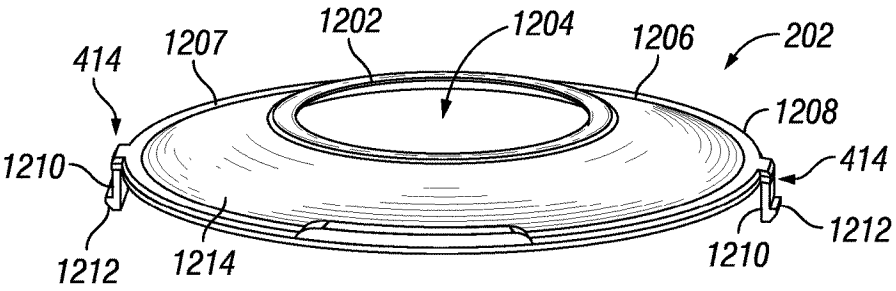
FIGS. 12A and 12B (collectively 'FIG. 12') illustrate a top perspective view and a bottom perspective view of the upper reflector of the trim assembly shown in FIG. 2, in accordance with an example embodiment of the present disclosure.
Figure 12B:
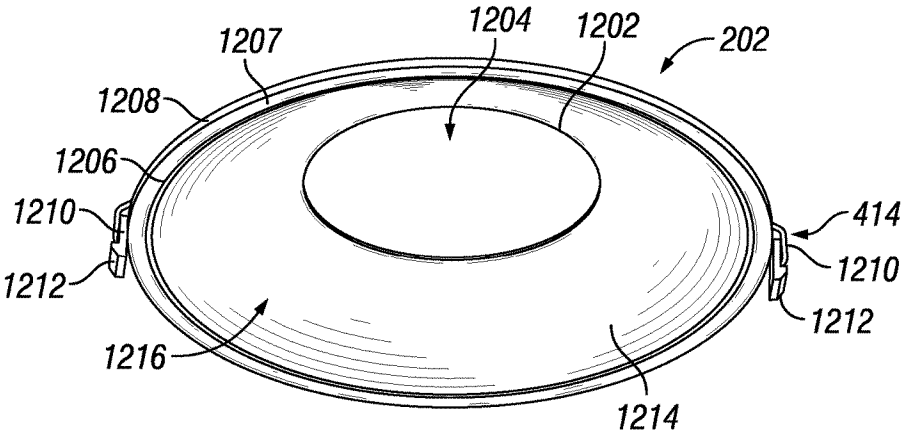
Figure 13:
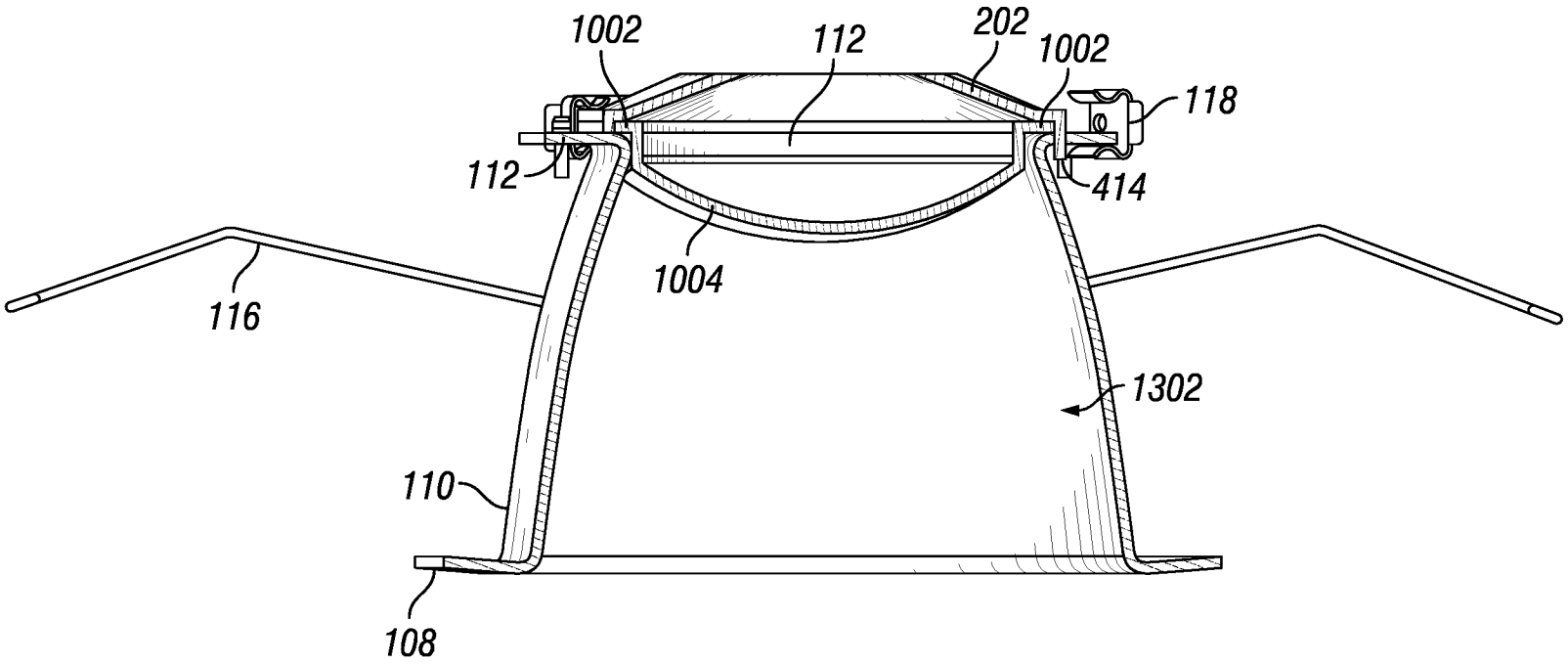
FIG. 13 illustrates a cross-sectional view of the trim assembly shown in FIG. 2 along an X-X' axis, in accordance with an example embodiment of the present disclosure.

Further, FIGS. 5A and 5B (collectively 'FIG. 5') illustrate a top perspective view and a bottom perspective view of an enclosure of the light module shown in FIG. 3, in accordance with an example embodiment of the present disclosure; FIG. 6 illustrates a perspective view of a wire cover member of the light module shown in FIG. 3, in accordance with an example embodiment of the present disclosure; FIG. 7 illustrates a perspective view of a light source of the example light-emitting diode based recessed lighting fixture shown in FIG. 1, in accordance with an example embodiment of the present disclosure; FIGS. 8A-8C (collectively 'FIG. 8') illustrate various example light module and heat sink assemblies, in accordance with an example embodiment of the present disclosure; FIG. 9 illustrates a perspective view of a trim of the trim assembly shown in FIG. 2, in accordance with an example embodiment of the present disclosure; FIG. 10 illustrates a perspective view of the trim assembly of FIG. 2 with the upper reflector removed, in accordance with an example embodiment of the present disclosure; FIG. 11 illustrates a coupling clip that engages and locks the light module and/or heat sink assembly to the trim assembly, in accordance with an example embodiment of the present disclosure; FIGS. 12A and 12B (collectively 'FIG. 12') illustrate a top perspective view and a bottom perspective view of the upper reflector of the trim assembly shown in FIG. 2, in accordance with an example embodiment of the present disclosure; and FIG. 13 illustrates a cross-sectional view of the trim assembly shown in FIG. 2 along an X-X' axis, in accordance with an example embodiment of the present disclosure.

Referring now to FIGS. 1-4 and 8, an example recessed light fixture 100 may include a trim assembly 102 and a light module 190, where the trim assembly 102 may be removably coupled to the light module 190 using one or more coupling members, such as coupling clips 118.

Light Module

In particular, as illustrated in FIG. 3, the light module 190 may include a module assembly 104 and an additional heat sink 106 (herein 'additional heat sink') that is optionally coupled to the module assembly 104 using one or more fasteners 308. Even though FIGS. 1, 3, and 4 illustrate the light module 190 as including an additional heat sink 106, one of ordinary skill in the art can understand and appreciate that in some example embodiments, the light module 190 may not include the additional heat sink 106 depending on the lumen output of the light module 190 or the drive current used to power a light source (shown in FIG. 7) of the light module 190. For example, light modules that have low lumen output may not use additional heat sink 106 as illustrated by the light module 802 of FIG. 8A. Instead, the enclosure 490 of the module assembly 104 may act as the heat sink for light modules 802 that have low lumen output. However, light modules that have medium or high lumen output may use the additional heat sinks 106 as illustrated by the light modules 804 and 806 of FIGS. 8B and 8C. The additional heat sink 106 may be a dedicated structure that provides additional surface area for dissipating the heat (which increases proportionally with the lumen output of the light modules) generated by the light source of the light module. As illustrated in FIGS. 8B and 8C, the size of the additional heat sink 106 that is coupled to the housing member 104 may vary (e.g., in height provided the width remains the same) based on the lumen output of the light module. For example, a light module 806 that has a high lumen output may use a larger additional heat sink 106*a* compared to that of a light module 804 that has a medium lumen output.

In certain example embodiments, the additional heat sink 106 may be an extruded metal, such as aluminum, that allows the height of the of the additional heat sink 106 to be easily increased for use with different light modules based on the lumen output of the light modules. However, in other example embodiments, the additional heat sink 106 may be formed using any other appropriate manufacturing process without departing from a broader scope of the present disclosure.

As illustrated in FIG. 3, the additional heat sink 106 may include an elongated center body 306 that extends from a top end 391 of the additional heat sink 106 to a bottom end 392 of the additional heat sink 106. In particular, the elongated center body 306 of the additional heat sink 106 may be defined by a flat surface 360 on one side and a substantially cylindrical surface 361 (spanning equal to or more than 180 degrees) on the opposite side. Further, the additional heat sink 106 may include a plurality of fins 304 that extend radially outwards from the cylindrical surface and from the top end 391 to the bottom end 392 of the additional heat sink 106. In certain example embodiments, as illustrated in FIG. 3, the fins 304 of the additional heat sink 106 may be shaped substantially similar to the fins 395 of the module assembly 104. However, in other example embodiments, the fins 304 of the additional heat sink 106 may have any other appropriate shape without departing from a broader scope of the present disclosure. Furthermore, the additional heat sink 106 may include a plurality of substantially C-shaped elongated tracks 302 that extend from the top end 391 to the bottom end 392 of the additional heat sink 106. For example, as illustrated in FIG. 3, the additional heat sink 106 may have elongated tracks 302 positioned adjacent each side of the flat surface 360 and an elongated track 302 on the cylindrical surface 361. In certain example embodiments, the elongated tracks 302 in the additional heat sink 106 may be positioned such that they substantially align with corresponding through apertures 502 (shown in FIG. 5) on the enclosure 490 of the module assembly 104.

In particular, as illustrated in FIGS. 3-5, the bottom end 392 of the additional heat sink 106 may be disposed on a top portion 404 of the module assembly 104 such that: (a) the elongated tracks 302 of the additional heat sink 106 are axially aligned with the through apertures 502 of the module assembly 104, and (b) the flat surface 360 of the additional heat sink 106 is disposed against (facing) a back wall 550 of a connector part 120 of the enclosure 490. Once the additional heat sink 106 is disposed on top of the module assembly 104 and the elongated tracks 302 are aligned with the through apertures 502 of the module assembly 104, fasteners 308, such as screws, may be passed through the axially aligned through apertures 502 of the module assembly 104 and the elongated tracks 302 of the additional heat sink 106 to couple the additional heat sink 106 to the module assembly 104. In particular, as illustrated in FIGS. 3 and 4, the head of the screw 308 remains within the module assembly 104 and the body (threaded portion or shank) of the screw is received by the elongated tracks 302 of the additional heat sink 106. Even though the present disclosure describes a specific way of coupling the additional heat sink to the module assembly, one of ordinary skill in the art can understand and appreciate that in other example embodiments, the additional heat sink may be coupled to any other portion of the module assembly using any other appropriate coupling mechanisms without departing from a broader scope of the present disclosure.

Referring now to FIGS. 4-7, the module assembly 104 may be described below in greater detail. In particular, the module assembly 104 may include a die-cast enclosure 490 and a wire cover member 412 that is coupled to the die-cast enclosure 490 (herein 'enclosure 490'). Even though the present disclosure describes the enclosure as being formed by a die-cast process, one of ordinary skill in the art can understand and appreciate that in other example embodiments, the enclosure may be formed using any other manufacturing process without departing from a broader scope of the present disclosure.

In certain example embodiments, the enclosure 490 may include a heat sink part 124 and a connector part 120. The heat sink part 124 of the die cast enclosure 490 may include a top portion 404 that has an outer surface 404*a* and an inner surface 404*b* opposite to the outer surface 404*a*, a bottom flange 541 that has an inner annular edge 545 that defines a circular opening 549 and an outer annular edge 543, and a body 547 that extends from the inner annular edge 545 of the bottom flange 541 to the perimeter of the top portion 404. As illustrated in FIG. 5B, the top portion 404 may have a perimeter that is defined by a straight edge 599 on one side and a curved (substantially semi-circular) edge 598 on an opposite side.

Additionally, the heat sink part 124 of the enclosure 490 may include a plurality of fins 395 that extend radially outward from the body 547 of the heat sink part 124 towards the outer annular edge 543 of the bottom flange 542. For example, some fins 395*a* extend all the way to the outer annular edge 543 of the bottom flange 541, while other fins 395*b* extend partially towards the outer annular edge 543 of the bottom flange 541 (e.g., from the perimeter of the top portion 404 till the inner annular edge 545 of the bottom flange 541). Further, the enclosure 490 may include one or more ledges 314 that extend from the inner annular edge 545 to the outer annular edge 543. The ledges 314 may be configured to receive an arm 1106*a* of coupling clips 118 (shown in FIG. 11) to engage and lock the light module 190 to the trim assembly 102 as shown in FIG. 1.

In particular, top portion 404 of the heat sink part 124 may include a plurality of through apertures 502 that extend from the outer surface 404*a* through the inner surface 404*b* of the top portion 404. As described above, the through apertures 502 may be configured to receive fasteners, such as screws 308, for coupling the module assembly 104 to the additional heat sink 106. Further, the top portion 404 of the heat sink part 124 may include a plurality of blind apertures 504 and 506 that are configured to receive fasteners for coupling the wire cover member 412 and a light assembly 410 to the enclosure (e.g., inner surface 404*b* of the enclosure 404*b*), respectively. Additionally, the bottom flange 541 of the enclosure 490 may include one or more notches 310 and 312 that are configured to accommodate a portion of a fastener, such as the head of a screw, disposed on a top collar 112 (shown in FIG. 9) of the trim assembly 102 when the light module 190 is coupled to the trim assembly 102.

Furthermore, as described above, the enclosure 490 may include a connector part 120. As illustrated in FIG. 5A, the connector part 120 may be raised above the heat sink part 124 to accommodate one or more connector receptacles 408 in a vertical position. The one or more connector receptacles 408 provide a connection point for external drivers to supply power to the light assembly 410 of the light module 190.

In particular, the connector part 120 may include a top surface 316, a front wall 551 that extends from a portion of the bottom flange 541 (particularly, inner annular edge 545) to a first edge of the top surface 316, a back wall 550 that is opposite to the front wall 551 and extends from the straight edge 599 of the heat sink part's top portion 404 to a second edge (opposite to first edge) of the top surface 316, and a pair of side walls 553 that extend from the side edges of the top surface 316 towards the bottom flange 341. The walls (550, 551, 553) of the connector part 120 may be arranged such that they define a hollow cavity 540 that is configured to house one or more connector receptacles 408. Further, as illustrated in FIG. 5B, the connector part 120 may include a screw boss 505 extending from the front wall 551 and including an aperture 504 configured to receive fasteners for coupling the wire cover member 412 to the enclosure 490.

In certain example embodiments, as illustrated in FIGS. 4 and 5A, the top surface 316 of the connector part 120 may include an opening 402 that aligns with a top end 408*a* of the one or more connector receptacles 408 such that the top end 408*a* of the one or more receptacles 408 is flush with the opening 402. Further, the top surface 316 may include a slot 406 and a through aperture 597 that aid in attaching a connector locking clip 122 to the top surface 316 of the connector part 120 using fasteners 316, as illustrated in FIG. 1.

The connector locking clip 122 may include flexible arms 123 that are configured to receive and securely retain a connector from an external power source such that connector pins (wire connectors) of the connector may matingly engage with the connector receptacles 408 in the connector part 120 to provide electrical power supply to the light assembly 410 (light source 702). In particular, as illustrated in FIG. 1, the connector locking clip 122 may be disposed on the top surface 316 of the connector part 120 such that: (a) an aperture of the connector locking clip 122 may be axially aligned with the aperture 597 on the top surface 316 of the connector part 120, (b) a tongue portion (not shown) of the connector locking clip 122 may be inserted into the slot 406, and (c) an opening of the clip 122 may be aligned with the opening 402 of the top surface of the connector part 120. Further, to attach the connector locking clip 122 to the connector part 120, a fastener 361 may be passed through the axially aligned apertures of the connector locking clip 122 and the top surface 316.

In some embodiments, the opening of the connector locking clip 122 and the opening 402 on the top surface 316 may be similar in size, however, in other embodiments, the opening of the connector locking clip 122 may differ in size from the opening 402 on the top surface 316 of the connector part 120 depending on the type of connector (2-pin, 4-pin, etc.) that is used to provide electrical power supply to the lighting fixture 100 from the external power source.

As described above, in addition to the enclosure 490, the module assembly 104 may include a wire cover member 412 and a light assembly 410 that are coupled the enclosure 490 using one or more fasteners. As illustrated in FIG. 7, the light assembly 410 may include a circuit board 701 and a light source 702 that is disposed on the circuit board 701. In particular, the light assembly 410 may be coupled to the heat sink part 124 of the enclosure 490 by aligning the notched corners 704 of a circuit board 701 with corresponding blind apertures 506 on the top portion 404 of the enclosure 490 and passing fasteners therethrough. Further, the light module 410 may be sandwiched between the enclosure 490 and the wire cover member 412 such that the light source 702 is disposed above and axially aligned with an opening 601 of the wire cover member 412. In other words, the light assembly 410 is disposed between the enclosure 490 and the wire cover member 412 such that light emitted by the light source 702 may exit the light module 190 through the opening 601 of the wire cover member 412.

In particular, the wire cover member 412 may be configured to route wires from an external power source (driver) to the light assembly 410 (particularly to terminals 706 of the circuit board 701) in a concealed manner. As illustrated in FIG. 6, the wire cover member 412 may include: the opening 601 that is configured to receive the light source 702 of the light assembly 410 therethrough, and one or more apertures 608. In certain example embodiments, the apertures 608 of the wire cover member 412 may be aligned with the blind apertures 504 of the enclosure, and fasteners may be passed therethrough to couple the wire cover member 412 to the enclosure 490. Further, the wire cover member 412 may include a connector receptacle support 610 that is configured to engage a bottom end 408*b* of the one or more connector receptacles 408 and securely retain the connector receptacle 408 within the connector part 124 of the enclosure 490.

Even though the present disclosure describes a module assembly having a specific shape, one of ordinary skill in the art can understand and appreciate that in other example embodiments, the module assembly and the different parts of the module assembly may have any other appropriate shape without departing from a broader scope of the present disclosure. Further, in other example embodiments, the module assembly may have fewer or more parts than that described herein. Furthermore, even though the present disclosure describes specific connectors for providing power supply to the light assembly, one of ordinary skill in the art can understand and appreciate that in other example embodiments, any other appropriate mechanisms may be used to provide power to the light assembly without departing from a broader scope of the present disclosure. For example, in some embodiments, the module assembly may not include the connector part. Instead, the module assembly may include an enclosure that has a planar top surface without the raised portion, and the module assembly may not include connector receptacles.

Trim Assembly

Referring now to FIGS. 2 and 9-13, the trim assembly 102 may include a trim 901, a top reflector 202, and a lens 416. In particular, the trim 901 may include a top annular edge 903 that defines a lens receiving opening 907, a bottom annular edge 905 that defines a light exit opening 909, and a trim body 110 that extends from the top annular edge 903 to the bottom annular edge 905. The diameter of the top annular edge 903 may be smaller than that of the bottom annular edge 905. However, in other example embodiments, the diameter of the top annular edge 903 may be substantially similar to or greater than that of the bottom annular edge 905.

Further, the trim 901 may include a top collar 112 that extends radially outward and substantially horizontally from the top annular edge 903, and a bottom collar 108 that extends radially outward and substantially horizontally (or upward at an angle) from the bottom annular edge 905. Furthermore, the trim 910 may include an optional trim ring (not shown) that may replace or may be used in addition to the bottom flange 108 of the trim 901.

As illustrated in FIG. 9, the top collar 112 may include a first set of through apertures 420 that are configured to couple one or more torsion brackets 114 to the trim 901 using fasteners, such as screws 204. Further, the top collar 112 may include a second set of through apertures 422 configured to couple one or more coupling clips 118 to the trim 901 using fasteners, such as rivets or screws 206.

Referring to FIG. 11, each coupling clip 118 may include a clip body 1108, a flange 1102 that extends substantially perpendicularly from the clip body 1108, and a pair of arms 1106 that extend substantially perpendicularly from the clip body 1108 and parallel to the flange 1102. The flange 1102 may include a through aperture 1104. In certain example embodiments, a coupling clip 118 may be coupled to the trim 901 by disposing the flange 1102 of the coupling clip 118 on the top collar 112 of the trim 901 such that the through aperture 1104 of the coupling clip 118 is axially aligned with the through aperture 422 of the top collar 112. Further, a fastener, such as a river or a screw 206 is passed through the aligned through apertures (1104, 422) of the coupling clip 118 and the trim 901. In particular, the coupling clips 118 may be configured to engage and removably couple the light module 190 to the trim assembly 102. As illustrated in FIGS. 1, 2, 4, and 10, one arm 1106*b* of the coupling clip 118 is disposed below the top collar 112 of the trim 901 and the second arm 1106*a* may be disposed above the ledge 341 on the bottom flange 541 of the light module's enclosure 490. That is, each coupling clip 118 securely retains a portion of the light module 190 and a portion of the trim assembly 102 in between the two arms 1106*a,b* of the coupling clip 118, thereby locking the light module 190 to the trim assembly 102.

Referring back to FIG. 9, in addition to the first set and second set of through apertures 420 and 422, the top collar 112 of the trim 901 may include one or more through slots 902. In particular, the through slots 902 are configured to receive and mate with locking tabs 414 of the top reflector 202 in order to couple the top reflector 202 to the trim 901.

Referring now to FIG. 12, the top reflector 202 may include a top annular edge 1202 that defines a first opening 1204, a bottom annular edge 1206 that defines a second opening 1216, and a reflector body 1214 that extends from the top annular edge 1202 to the bottom annular edge 1206. Further, the top reflector 202 (herein 'reflector 202') may include a collar 1207 that extends radially outward and substantially horizontally from the bottom annular edge 1206 of the reflector 202. Furthermore, the reflector 202 may include a pair of locking tabs 414 disposed on opposite sides of the reflector 202. In particular, the locking tabs 414 extend downward and substantially perpendicular to the collar 1207 from the outer edge 1208 of the collar 1207. Each locking tab 414 may include: a first leg 1210 that extends downward and substantially perpendicular to the collar 1207, and a second leg that extends upward at an angle to the first leg and away from the reflector body 1214 from an end of the first leg 1210 that is away from the flange 1207. Even though the present disclosure describes a reflector 202 having a pair of locking tabs, one of ordinary skill in the art can understand and appreciate that in other example embodiments, the reflector 202 may have fewer or more locking tabs without departing from a broader scope of the present disclosure. Further, even though the present disclosure describes the reflector as having locking tabs to couple the reflector to the trim, one or ordinary skill in the art can understand and appreciate that in other example embodiments, the reflector may include any other appropriate coupling mechanism to couple the reflector to the trim without departing from a broader scope of the present disclosure.

In certain example embodiments, the reflector 202 may be fabricated using a reflective material, such as aluminum or highly reflective white plastic. However, in other example embodiments, the reflector 202 may be fabricated using a non-reflective material and subsequently made to be reflective. For example, the inner surface of the reflector 202 may be polished or may be painted to be made reflective. In certain example embodiments, the inner surface of the reflector 202 may also be configured to diffuse light in addition to reflecting the light in order to provide a smoother distribution of light. Similarly, in certain example embodiments, the inner surface of the trim 901 may be polished or may be painted to be made reflective. Alternately, the trim 901 may be fabricated using a reflective material, such as aluminum or highly reflective white plastic.

As described above, in addition to the reflector 202 and the trim 901, the trim assembly 102 may include the lens 416. As illustrated in FIG. 10, the lens 416 may include a curved or substantially dome shaped surface 1004 and a collar 1002 that extends radially outward and substantially horizontally from a top edge 1001 of the lens 416. In certain example embodiments, the lens 416 may be a diffuser lens that diffuses, spreads out, or scatters light in some manner, to give soft light. However, in another example embodiment, instead of or in addition to the diffuser characteristic, the lens 416 may have reflective characteristics. That is, the lens 416 may be configured to reflect at least a portion of received light while allowing a remaining portion of light to pass through based on an angle of incidence of light on the lens surface 1004. In certain example embodiments, the lens 416 may be fabricated from an acrylic material and may be substantially clear or translucent. Alternatively, the lens 416 may be formed using other suitable materials, such as glass, and can be, or made to be, opaque, if desired.

Even though the present disclosure describes a lens having a substantially dome shaped surface, one of ordinary skill in the art can understand and appreciate that in other example embodiments, the lens may have any other appropriate shape without departing from a broader scope of the present disclosure. For example, the lens may have a flat surface instead of having a dome shaped surface.

Referring to FIGS. 10 and 13, the reflector 202 and the lens 416 may be coupled to the trim 901 to form the trim assembly 102 such that the lens 416 is disposed between the reflector 202 and the trim 901. In particular, the collar 1002 of the lens 416 is disposed on the top collar 112 of the trim 901 such that the remainder of the lens 416, i.e., the curved surface 1004 of the lens 416 passes through the lens receiving opening 907 of the trim 901 and rests within the cavity 1302 defined by the trim body 110. In other words, the top collar 112 of the trim 901 supports and holds the lens 416 in position within the trim 901. Further, the reflector 202 is coupled to the trim 901 by: (a) placing the reflector 202 on top of the lens 416 such that the collar 1207 of the reflector is disposed on the collar 1002 of the lens 416, (b) aligning the locking tabs 414 of the reflector 202 with the through slots 902 on the top collar 112 of the trim 901, and (c) inserting/snapping the locking tabs 414 of the reflector 202 into the through slots 902 on the top collar 112 of the trim 901. Once the locking tabs 414 of the reflector 202 are inserted into through slots 902 on the top collar 112 of the trim 901, the second leg 1212 (angled upwards) of each locking tab 414 engages a bottom surface of the top collar 112 to lock the reflector 202 to the trim 901.

Further, as illustrated in FIGS. 1 and 4, the trim assembly 102 may be removably coupled to the light module 190 using the coupling clips 118 such that: (a) an outer surface of the reflector 202 is disposed against an inner surface of the wire covering member 412, and (b) the light source 702 and the opening 601 of the light module 190 are axially aligned with the first opening 1204 in the reflector 202 of the trim assembly 102. That is, in operation, the light emitted by the light source 702 of the light module 190 enters the trim assembly 102 through the first opening 1204 of the reflector 202 and passes through the lens 416 to exit the light fixture 100 through the light exit opening 909 of the trim assembly 102.

Although the disclosures provides example embodiments, it should be appreciated by those skilled in the art that various modifications are well within the scope of the disclosure. From the foregoing, it will be appreciated that an embodiment of the present disclosure overcomes the limitations of the prior art. Those skilled in the art will appreciate that the present disclosure is not limited to any specifically discussed application and that the embodiments described herein are illustrative and not restrictive. From the description of the example embodiments, equivalents of the elements shown therein will suggest themselves to those skilled in the art, and ways of constructing other embodiments of the present disclosure will suggest themselves to practitioners of the art. Therefore, the scope of the present disclosure is not limited herein.

What is claimed is:

1. A light fixture comprising:

a light module that includes a light source; and a trim assembly that is removably coupled to the light module, the trim assembly comprising:

a trim comprising a top collar that extends radially outward from a top edge of the trim that defines a lens receiving opening, wherein the top collar comprises one or more through slots;

a reflector comprising:

a top edge defining a first opening, a bottom edge defining a second opening that is disposed below the first opening, a body extending from the top edge of the reflector to the bottom edge of the reflector, a collar extending radially outward and substantially horizontally from the bottom edge of the reflector, and one or more tabs extending downward and substantially perpendicular to the collar of the reflector from an outer edge of the collar; and a lens comprising a collar and a curved surface, wherein the lens is securely retained between the reflector and the trim such that: (a) the collar of the lens is disposed between the collar of the reflector and the top collar of the trim, and (b) the curved surface of the lens is disposed below the second opening of the reflector and received through the lens receiving opening of the trim, and wherein the reflector is coupled to the trim by inserting each tab of the one or more tabs of the reflector through a respective through slot of the one or more through slots on the top collar of the trim.

2. The light fixture of claim 1, wherein the trim further comprises: a bottom collar that extends radially outward from a bottom edge of the trim that defines a light exit opening, and a trim body that extends from the top edge of the trim to the bottom edge of the trim.

3. The light fixture of claim 1, further comprising one or more torsion spring brackets and torsion springs that are coupled to the top collar of the trim, wherein the torsion spring brackets and torsion springs are configured to recess mount the light fixture.

4. The light fixture of claim 1, further comprising a plurality of coupling clips that are coupled to the top collar of the trim, wherein the plurality of coupling clips are configured to removably couple the light module to the trim assembly.

5. The light fixture of claim 1, wherein the light module is removably coupled to the trim assembly such that: the light source of the light module is disposed adjacent to, above, and axially aligned with the first opening of the reflector, and light emitted by the light source of the light module enters the trim assembly through the first opening of the reflector.

6. The light fixture of claim 1, wherein the light module comprises a module assembly that accommodates the light source and one or more connector receptacles that provide a connection point for a connector from an external power source to supply a drive current to the light source, and wherein the light source is a light emitting diode (LED).

7. The light fixture of claim 6, wherein the light module comprises an enclosure, wherein the light source is disposed on and coupled to the enclosure, and wherein the enclosure operates as a heat sink when the light module is powered by a first range of drive currents.

8. The light fixture of claim 6, wherein an additional heat sink is removably coupled to the enclosure when the light module is powered by a second range of drive currents, and wherein the second range of drive currents is greater than the first range of drive currents.

9. A trim assembly, comprising:

a trim comprising:

a trim body that extends from the top annular edge to the bottom annular edge of the trim, wherein the top annular edge defines a lens receiving opening and the bottom annular edge defines a light exit opening, a top collar that extends radially outward from a top edge of the trim, wherein the top collar comprises one or more through slots, a bottom collar that extends radially outward from a bottom edge of the trim;

a reflector comprising a collar that extends radially outward from a bottom edge of the reflector, and one or more tabs extending downward and substantially perpendicular to the collar of the reflector from an outer edge of the collar; and a lens comprising a curved surface and a collar extending radially outward from a top edge of the lens, wherein the lens is securely retained between the reflector and the trim such that: (a) the collar of the lens is disposed between the collar of the reflector and the top collar of the trim, and (b) the curved surface of the lens is disposed below the reflector and received through the lens receiving opening of the trim, and wherein the reflector is coupled to the trim by inserting each tab of the one or more tabs of the reflector through a respective through slot of the one or more through slots on the top collar of the trim.

10. The trim assembly of claim 9, wherein the trim assembly is configured to be removably coupled to a light module that comprises a light source.

11. The trim assembly of claim 9, wherein the trim assembly further comprises one or more coupling clips that are coupled to the top collar of the trim and configured to removably couple the trim assembly to a light module comprising a light source.

12. The trim assembly of claim 9, wherein the trim assembly further comprises one or more torsion spring assemblies that are coupled to the top collar of the trim, wherein each torsion spring assembly comprises a torsion spring bracket and a torsion spring that is attached to the torsion spring bracket.

13. The trim assembly of claim 9, wherein the top collar of the trim further comprises one or more through apertures configured to couple at least one of a torsion spring bracket and a coupling clip to the trim using fasteners.

14. The trim assembly of claim 9, wherein the bottom edge of the reflector defines a second opening, wherein the reflector comprises a top edge that defines a first opening and a reflector body that extends from the top edge to the bottom edge, and wherein the diameter of first opening is smaller than the second opening.

15. A light fixture comprising:

a light module comprising:

a module assembly, wherein the module assembly comprises:

an enclosure, a wire cover member that is disposed below and coupled to the enclosure, wherein the wire cover member includes an opening, and a light source coupled to the enclosure and disposed in between the enclosure and the wire cover member such that the light source is configured to emit light through the opening of the wire cover member; and a trim assembly that is removably coupled to the light module, the trim assembly comprising:

a lens;

a trim comprising a top collar that extends radially outward from a top edge of the trim that defines a lens receiving opening, wherein the top collar comprises one or more through slots; and a reflector comprising a collar and one or more tabs extending downwards and substantially perpendicular to the collar of the reflector from an outer edge of the collar, wherein the reflector is coupled to the trim by inserting each tab of the one or more tabs of the reflector through a respective through slot of the one or more through slots on the top collar of the trim such that the lens is securely retained between the reflector and the trim.

16. The light fixture of claim 15, wherein the module assembly further comprises a plurality of connector receptacles that is disposed between the enclosure and the wire cover member, and wherein the plurality of connector receptacles provide a connection point for a connector from an external power source to supply drive current to the light source.

17. The light fixture of claim 15, wherein the enclosure comprises a plurality of heat sink fins, and wherein the enclosure operates as a heat sink to dissipate heat generated by the light source.

18. The light fixture of claim 15, wherein the enclosure of the light module is configured to be removably coupled to an additional heat sink.

19. The light fixture of claim 15, wherein the lens comprises a substantially dome shaped surface and a collar that extends radially outward from an edge of the dome shaped surface.

20. The light fixture of claim 19, wherein the reflector is coupled to the trim such that: (a) the collar of the lens is disposed in between the collar of the reflector and the top collar of the trim, and (b) the substantially dome shaped surface of the lens is disposed below the reflector and received through the lens receiving opening of the trim.

* * * * *